US006964261B2

(12) United States Patent
Warne et al.

(10) Patent No.: US 6,964,261 B2
(45) Date of Patent: Nov. 15, 2005

(54) ADAPTIVE FUEL INJECTOR TRIMMING DURING A ZERO FUEL CONDITION

(75) Inventors: David G. Warne, Peterborough (GB); John Renshaw, Upwell (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 10/733,017

(22) Filed: Dec. 11, 2003

(65) Prior Publication Data

US 2005/0126538 A1 Jun. 16, 2005

(51) Int. Cl.[7] ..... F02D 41/04; F02M 65/00

(52) U.S. Cl. ..... 123/436; 123/479; 73/119 A; 73/117.3; 701/104; 701/112; 701/114

(58) Field of Search ..... 123/436, 479; 701/104, 112, 114; 73/119 A, 117.3

(56) References Cited

U.S. PATENT DOCUMENTS 4,977,872 A * 12/1990 Hartopp ..... 73/119 A
5,063,901 A * 11/1991 Kaneyasu et al. ..... 123/479
5,445,019 A * 8/1995 Glidewell et al. ..... 73/119 A
5,582,152 A 12/1996 Drutel et al.
5,633,458 A * 5/1997 Pauli et al. ..... 73/119 A
5,773,716 A * 6/1998 Antonioli et al. ..... 73/119 A
6,021,754 A 2/2000 Kendrick
6,502,551 B2 * 1/2003 Antonioli et al. ..... 73/119 A
6,588,398 B1 * 7/2003 Rodier ..... 73/119 A
6,705,295 B1 * 3/2004 Tarroux et al. ..... 73/119 A
6,712,045 B1 * 3/2004 McCarthy, Jr. ..... 73/119 A
2002/0148441 A1 * 10/2002 Tuken ..... 123/436

FOREIGN PATENT DOCUMENTS

EP 0 940 571 A2 9/1999
EP 1 132 600 A2 9/2001

* cited by examiner

*Primary Examiner*—Erick Solis

(57) ABSTRACT

Apparatuses and methods for controlling a fuel injector. A fuel shot is injected during a zero fuel condition. A rail pressure drop corresponding to the fuel shot is determined. A change in engine speed corresponding to the fuel shot is determined. An adjustment to the fuel injection as a function of the rail pressure drop and the corresponding change in engine speed is determined.

16 Claims, 3 Drawing Sheets

ADAPTIVE FUEL INJECTOR TRIMMING DURING A ZERO FUEL CONDITION

TECHNICAL FIELD

This invention relates generally to a fuel injector, and more specifically, to the trimming of fuel injectors.

BACKGROUND

Electronically controlled fuel injectors are known to change over time in fuel injection quantity for a given injector signal on-time. Inconsistency in the amount of fuel delivered can lead to higher undesirable emissions requirements than if the fuel injector was calibrated.

One potential solution to this problem is the periodic recalibration of the fuel injector during routine servicing. Relying on this approach, however, is dependent on the routine servicing actually occurring, and occurring at an interval-that is shorter than that which allows the fuel injector to substantially deviate from its initial fuel injection characteristics.

SUMMARY OF THE INVENTION

The present invention provides apparatuses and methods for controlling a fuel injector. A fuel shot is injected during a zero fuel condition. A rail pressure drop corresponding to the fuel shot is determined. A change in engine speed corresponding to the fuel shot is determined. An adjustment to the fuel injection as a function of the rail pressure drop and the corresponding change in engine speed is determined.

DETAILED DESCRIPTION

Figure 1:
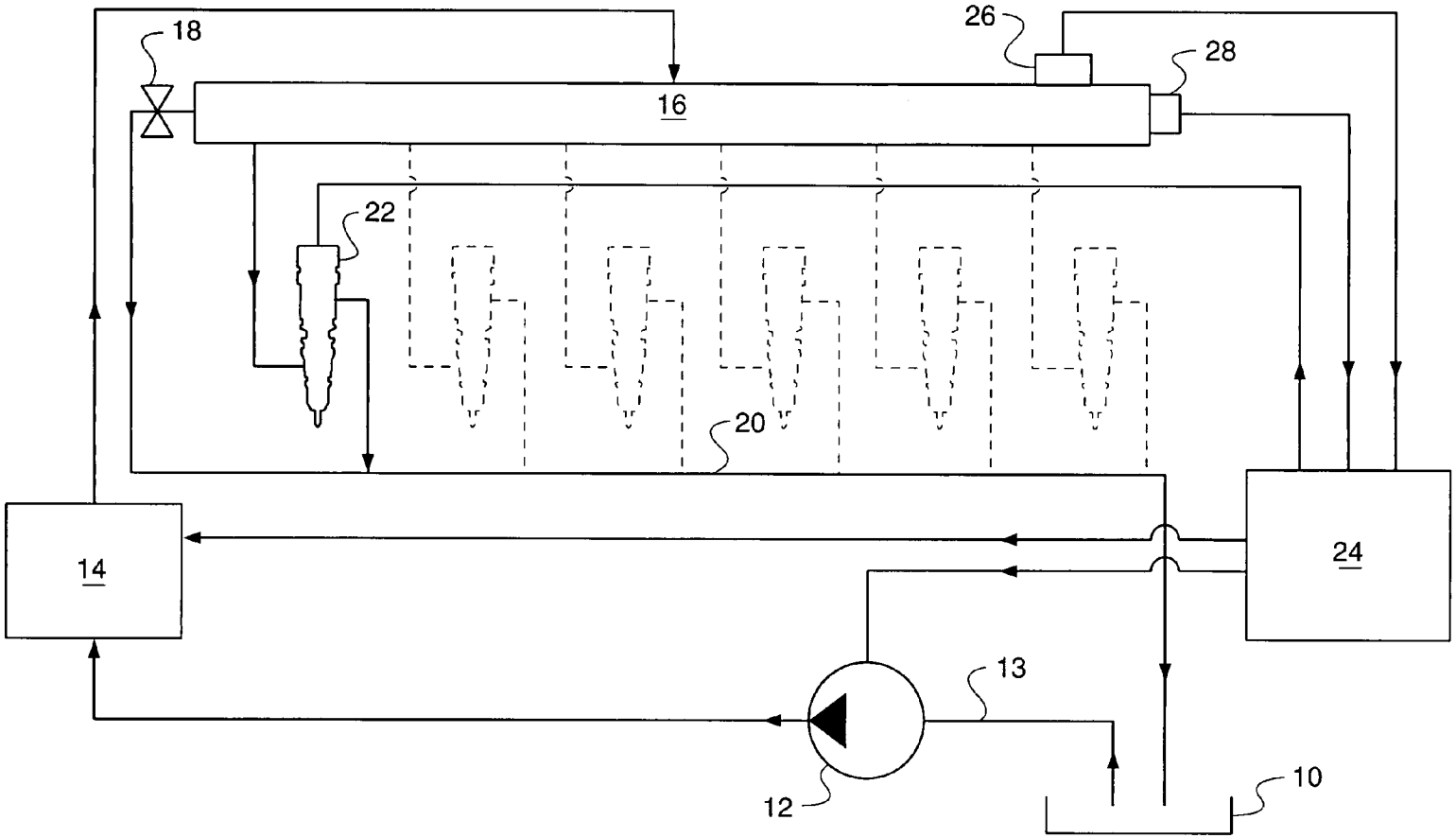
FIG. 1 is a fuel system utilizing a common rail fuel injector 22 according to one embodiment of the invention.

Referring to FIG. 1, a fuel system utilizing a common rail fuel injector 22 according to one embodiment of the invention is shown. Although for exemplary purposes, the discussions herein describe a common rail fuel injector, the invention may apply equally to other types of fuel injectors. A reservoir 10 contains fuel at an ambient pressure. A transfer pump 12 draws low-pressure fuel through fuel supply line 13 and provides it to high-pressure pump 14. High-pressure pump 14 then pressurizes the fuel to desired fuel injection pressure levels and delivers the fuel to fuel rail 16. The pressure in fuel rail 16 is controlled in part by safety valve 18, which spills fuel to the fuel return line 20 if the pressure in rail 16 is above a desired pressure. The fuel return line 20 returns fuel to low-pressure reservoir 10.

Fuel injector 22 draws fuel from rail 16 and injects it into a combustion cylinder of the engine (not shown) by ways known to those skilled in the art. Fuel not injected by injector 22 is spilled to fuel return line 20. An engine control module, such as Electronic Control Module ("ECM") 24 provides general control for the system. ECM 24 receives various input signals, such as from pressure sensor 26 and a temperature sensor 28 connected to fuel rail 16, to determine operational conditions. ECM 24 then sends out various control signals to various components including the transfer pump 12, high-pressure pump 14, and fuel injector 22.

Figure 2A:
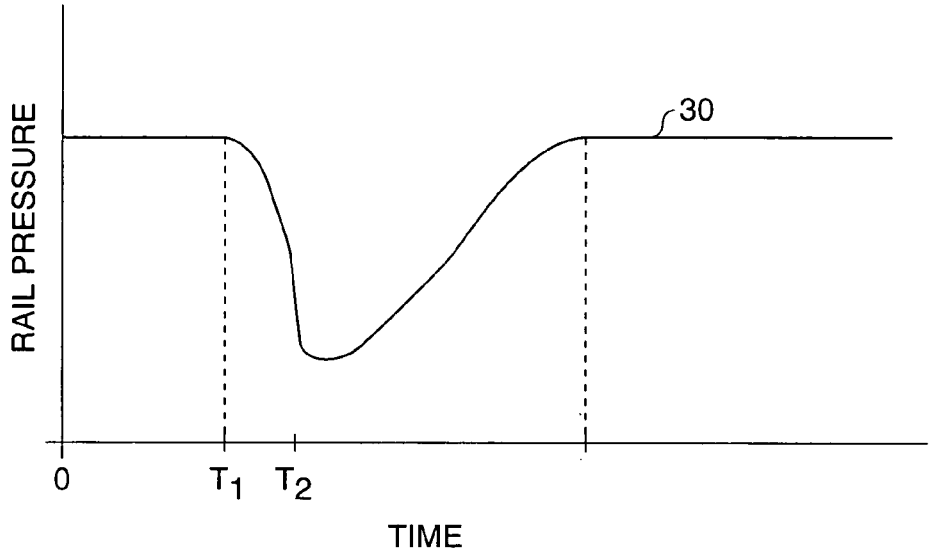
FIG. 2*a* is a graph showing the rail pressure of a fuel injector during a zero fuel condition according to one embodiment of the invention.
Figure 2B:
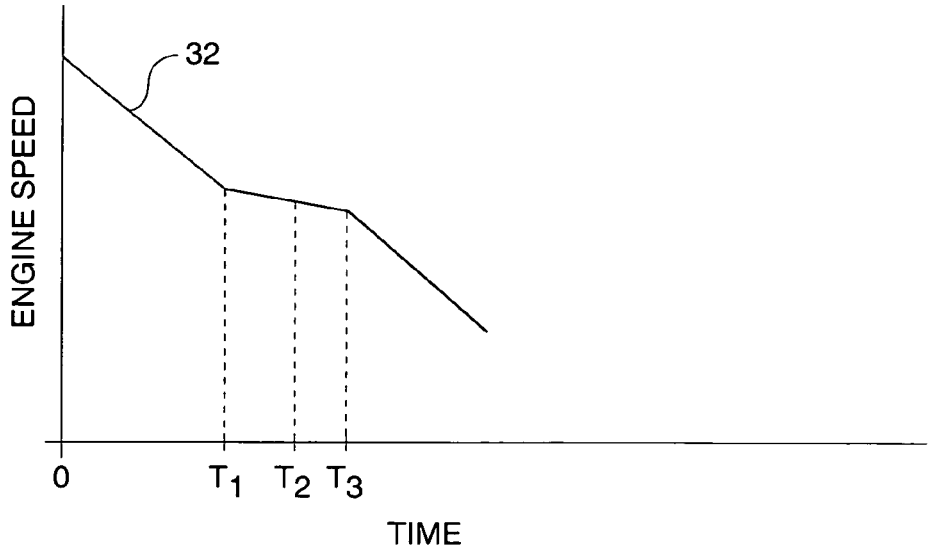
FIG. 2*b* is a graph showing an engine speed of an engine having the fuel injector of FIG. 1*a* during a zero fuel condition according to one embodiment of the invention.

FIG. 2 is graphs showing the rail pressure (FIG. 2*a*) of a fuel injector (not shown) and engine speed (FIG. 2*b*) of an engine having the fuel injector during a zero fuel condition according to one embodiment of the invention. A zero fuel condition may be any condition of the engine where the fuel injector normally injects no fuel or substantially zero fuel. Some examples of this may be a deceleration, such as slowing from a powered condition to an idle condition, and an engine "key-off" condition where the engine is commanded to shut down.

FIG. 2*a* shows a graph 30 of rail pressure for a fuel injector during a zero fuel condition according to one embodiment of the invention. As mentioned above, the rail pressure is the pressure of the fluid supplied to the fuel injector.

At time zero, during a zero fuel condition the rail pressure may be substantially stable at some predetermined value or steadily changing at a predictable rate. At a time slightly before time $T_1$ the fuel injector is commanded to inject fuel. After a short delay, at around time $T_1$ the fuel injector begins to inject fuel, and the rail pressure begins to drop from the stable condition or relative to the predictable rate. At around time $T_2$ the fuel injector finishes its fuel injection, and rail pressure begins to build back to its steady state pressure if demanded by the controller or continues to change steadily at the predictable rate.

FIG. 2*b* is a graph 32 of engine speed during a zero fuel condition for an engine having a fuel injector that has a rail pressure according to FIG. 1*a*, according to one embodiment of the invention. As can be seen, during the zero fuel condition the engine speed 32 decreases from its powered engine speed towards zero. For simplicity purposes, the decrease in engine speed is depicted as being linear, although it could have other characteristics as known by those skilled in the art. At around time $T_1$, when the fuel injector begins to inject, the rate of decay for the engine speed may be attenuated. This can be seen by the reduced slope of the engine speed 32 between times $T_1$ and time $T_2$.

At around time $T_2$, the fuel injector finishes its injection.

At around time $T_3$ the fuel is fully combusted by ways known to those skilled in the art. Typically there may be a slight delay time from the end of fuel injection to the end of combustion and the end of the power stroke of a piston in the cylinder receiving the fuel injection. The lag time between time $T_2$ and time $T_3$ may vary by ways known to those skilled in the art, and in some embodiments of the invention, could be substantially zero.

Although the rate of change in the engine speed is shown as only reducing the rate of decay, in other embodiments of the invention, depending on the quantity of fuel injected at time $T_1$ the engine speed 32 could actually increase, i.e., graph 32 would have a positive slope starting at around time $T_1$.

At around time $T_3$ the combustion and power stroke of the piston are substantially complete, and the decay in engine speed begins again.

The rail pressure monitoring and the fuel injection may be performed during a zero fuel condition to maximize the stability of the rail pressure. If other fuel injections are occurring, such as in other cylinders of the engine, the fluctuations in rail pressure from those injections may affect the rail pressure of the fuel injector being analyzed. By performing the analysis during a zero fuel condition, these fluctuations are minimized, or removed altogether.

Another potential benefit to performing the analysis during a zero fuel condition may be that the engine speed may be relatively slow, since fuel is not being delivered to the engine. This may allow for increased resolution in the measurements that are being performed because, for example, the engine's operating characteristics are not in rapid flux.

In embodiments of the invention, during a zero fuel condition, such as engine shutdown, the engine controller may need to remain active and powered to perform the fuel injector analysis and adjustment. A simple timer that delays the shutdown of the engine controller when the adjustment to the fuel injector is desired may accomplish this, for example.

In some embodiments of the invention, a potential benefit to performing the adjustment during an engine shutdown is that the engine controller normally does little or no processing during engine shutdown. Thus, there may not be any issues regarding resource sharing and availability of the engine controller.

Similar to the delay of the engine controller shut down, the shutdown of the fuel system may also need to be delayed for obvious reasons.

Figure 3:
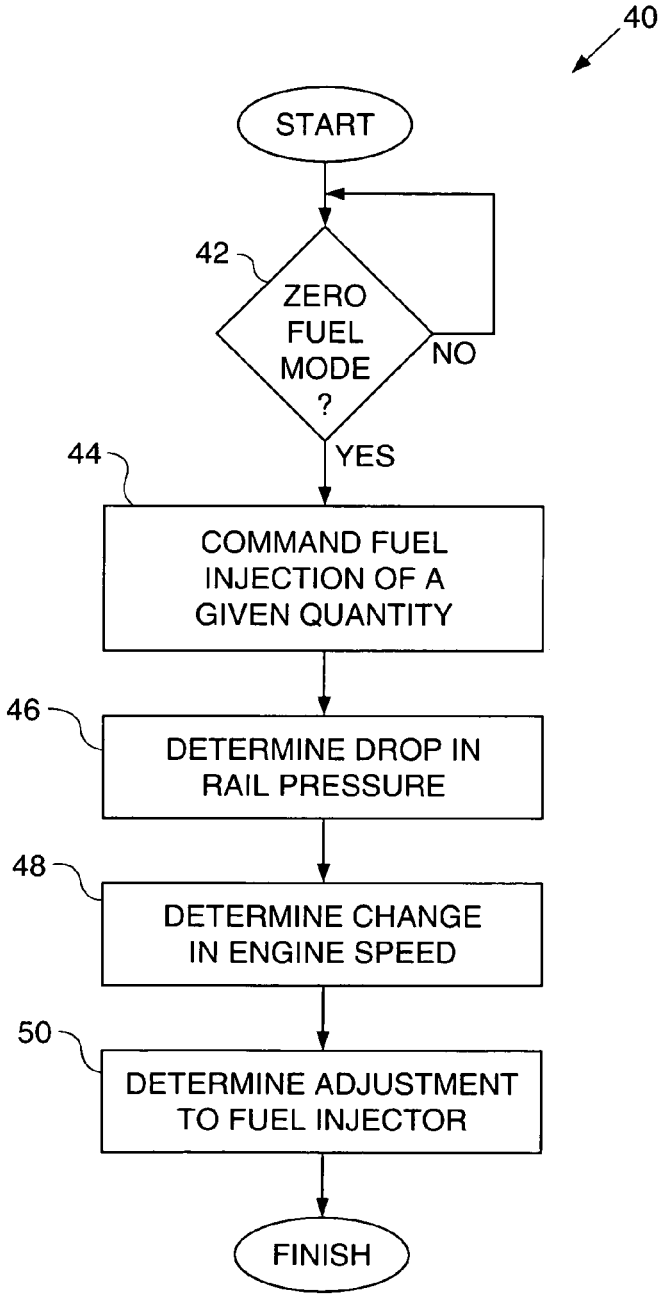
FIG. 3 is a flowchart showing a process for adjusting the performance of a fuel injector according to one embodiment of the invention.

FIG. 3 is a flowchart 40 showing a process for adjusting the performance of a fuel injector according to one embodiment of the invention. In block 42 it is determined whether or not the engine is operating in a zero fuel mode. This may be accomplished by various ways, such as, for example, by monitoring the rail pressure of the fuel injector(s) of the engine. If the rail pressure is substantially constant, this typically indicates that no fuel injections are occurring, and a zero fuel condition exists. Similarly, the key position for the engine may be monitored. If the key position is in an ignition off position, then a zero fuel condition likely exists. Other ways to determine a zero fuel condition known to those skilled in the art may also be used, as appropriate.

If zero fuel mode is found to not exist for the engine, control reverts back to block 42. If zero fuel mode is found to exist, control passes to block 44.

In block 44 the fuel injector is commanded to inject a given quantity of fuel. The precise quantity of fuel chosen may vary depending on operating characteristics of the fuel injector, or even on a whim.

In block 46 the drop in rail pressure for the fuel injector as a result of the fuel injection is determined. This value is indicative of the quantity of fuel injected into the cylinder of the engine.

In block 48 the change in engine speed as a result of the fuel injected. In embodiments of the invention, the change in the rate of decay of the engine speed may be used.

In block 50, an adjustment to the fuel injector is determined as a function of the commanded fuel injection quantity, the drop in rail pressure, and the change in engine speed or rate of change in engine speed. In another embodiment of the invention, only one of the commanded fuel injection quantity and the drop in rail pressure, in combination with the change in engine speed, may be used to determine the adjustment to the fuel injector.

It may be noted that in some embodiments of the invention, the drop in rail pressure may tend to be independent of the load on the engine, e.g., the application, as well as inertial qualities of the engine itself, while the change in engine speed for a given amount of fuel injection will typically be dependent on the load on the engine. Thus, if determining the drop in rail pressure is omitted, it may be necessary to have data on the load on the engine in order to accurately adjust the fuel injector.

If, for example, the change in engine speed was less than expected for a given amount of time, or the rate of change was greater than expected, in the case of an engine speed that is normally decreasing, e.g., a zero fuel condition, then the fuel injector may be injecting less fuel than desired for a given command to inject, and may be adjusted appropriately by ways known to those skilled in the art. If the change in engine speed for the given amount of time is greater than expected, or the rate of change was less than expected, in the case of an engine speed that is normally decreasing, then the fuel injector may be injecting more fuel than desired for a given command to inject, and may be adjusted appropriately by ways known to those skilled in the art. In either case, the expected change in engine speed or rate of change of engine speed may be determined by various ways known to those skilled in the art, such as, for example, baseline testing of the engine and fuel injector, modeling the expected performance of the engine and fuel injector, or other techniques known to those skilled in the art.

In one embodiment of the invention, the adjustment to the fuel injector may be changing the duration of the signal that causes the fuel injector to inject. Typically by increasing the duration of this signal, the fuel injector remains open longer, injecting more fuel. Similarly, by shortening the duration of this signal, the fuel injector closes earlier, injecting less fuel. This may be accomplished in embodiments of the invention by modifying an engine map that correlates fuel delivery with fuel injector on-time.

In other embodiments of the invention, other techniques for adjusting the fuel injector known to those skilled in the art may be used.

In other embodiments of the invention, the process for adjusting a fuel injector may involve measuring an initial engine speed rate of decay, injecting a predetermined quantity of fuel, measuring the new engine speed rate of decay, and measuring again without a new fuel injection. The speed changes between the injection period and the non-injection period can then be compared to determine the actual performance of the fuel injector.

In other embodiments of the inventions, the adjustment to the fuel injector may occur only after several zero fuel conditions occur. For example, the analysis of the fuel injector performance may be performed several times, with the adjustment to the fuel injector performance being an average of the tests. This type of testing regime may account for random environmental factors that could have an effect on fuel delivery.

Other variations are also possible. For example, for a multi-cylinder engine, it may be possible to sample the conditions for cylinder 1 during the first zero fuel condition, sample the conditions for cylinder 2 during a second zero fuel condition, etc., cycling through the cylinders until sufficient data has been collected to reliably make the electronic adjustment.

In embodiments of the invention, the precise timing of the beginning of injection of the fuel shot may be varied. Obviously, the effect on engine speed may vary and need to be accounted for as a function of when the injection occurs by ways known to those skilled in the art. For example, injecting early in the power stroke may not provide as much time for the combustion pressure within the cylinder to act on the piston, resulting in less force for the power stroke and therefore a smaller change in engine speed when compared to injecting during the compression stroke.

Similarly, in multi-shot fuel injection strategies, the fuel shot for adjustment of the fuel injector could be the first, second, third, etc. shot of the multi-shot injection strategy.

In some embodiments of the invention, the above techniques for adjusting a fuel injector may not be used every time the engine enters a zero fuel condition. It may be desirable, for improved accuracy, for example, to only perform the analysis and adjustment when the engine is at predetermined conditions, such as a working temperature, as indicated by coolant temperature or oil temperature, and having a relatively stable rail pressure.

Although the above discussion has focused on analyzing the injector during a zero fuel condition, in other embodiments of the invention any controlled, predictably known conditions of operation for the engine may be used.

INDUSTRIAL APPLICABILITY

The present invention may be used to recalibrate the fuel injectors on engines to compensate for the natural change in the quantity of fuel injected as the injector ages. This may result in more consistent fuel quantities injected for a given command over the life of the injector, which in turn may lead to reduced emissions and increased fuel economy.

The recalibration may be automatically performed whenever a zero fuel condition or other appropriate controlled, predictably known condition exists. This will likely result in a more frequent recalibration of the fuel injector than conventional prior art techniques tend to use.

From the foregoing it will be appreciated that, although specific embodiments of the invention have been described herein for purposes of illustration, various modifications may be made without deviating from the spirit or scope of the invention. Accordingly, the invention is not limited except as by the appended claims.

What is claimed is:

1. An apparatus for controlling a fuel injector, comprising:

a rail pressure sensor coupled with a rail of the fuel injector and operable to transmit a rail pressure signal as a function of the rail pressure during a zero fuel condition;

an engine speed sensor operable to be coupled with an engine, the engine speed sensor operable to transmit an engine speed signal as a function of the engine speed of the engine during the zero fuel condition; and a controller coupled with the rail pressure sensor to receive the rail pressure signal and with the engine speed sensor to receive the engine speed signal, the controller operable to transmit an injection signal to the fuel injector that is operable to cause the fuel injector to inject fuel into the engine, the controller further operable to determine an adjustment to the injection signal as a function of the rail pressure signal and the engine speed signal received during the zero fuel condition.

2. The apparatus of claim 1 wherein the zero fuel condition comprises at least one of:

an engine deceleration; and an engine shut-down.

3. The method of claim 1 wherein the adjustment comprises:

an increase in the quantity of a subsequent fuel shot for a predetermined condition when the rate of change in engine speed corresponding to the at least one fuel shot is less than a predetermined value; and a decrease in the quantity of a subsequent fuel shot for a predetermined condition when a rate of change in engine speed corresponding to the at least one fuel shot is greater than a predetermined value.

4. The apparatus of claim 1 wherein the adjustment comprises:

an increase to the duration of a subsequent fuel shot when the rate of change in engine speed corresponding to the fuel shot is less than a predetermined value; and a decrease to the duration of a subsequent fuel shot when a rate of change in engine speed corresponding to the fuel shot is greater than a predetermined value.

5. The apparatus of claim 1 wherein the rail pressure drop comprises a rail pressure drop of a rail supplying fluid to the fuel injector.

6. The apparatus of claim 5 wherein the fluid comprises one of:

gasoline;

diesel fuel; and hydraulic fluid.

7. The apparatus of claim 1 wherein the adjustment to the injection signal comprises an adjustment to the fuel injection signal as a function of a predetermined mathematical formula of a plurality of rail pressure drops and their corresponding changes in engine speed.

8. The apparatus of claim 7 wherein the predetermined mathematical formula comprises at least one of:

an average of a plurality of rail pressure drops and their corresponding changes in engine speed; and a weighted average of a plurality of rail pressure drops and their corresponding changes in engine speed.

9. A method for controlling a fuel injector, comprising:

injecting a fuel shot during a zero fuel condition;

determining a rail pressure drop corresponding to the fuel shot;

determining a change in engine speed corresponding to the fuel shot; and determining an adjustment to the fuel injection as a function of the rail pressure drop and the corresponding change in engine speed.

10. The method of claim 9 wherein the zero fuel condition comprises at least one of:

an engine deceleration; and an engine shut-down.

11. The method of claim 9 wherein the adjustment comprises:

increasing the quantity of a subsequent fuel shot for a predetermined condition when the rate of change in engine speed corresponding to the fuel shot is less than a predetermined value; and decreasing to the quantity of a subsequent fuel shot for a predetermined condition when a rate of change in engine speed corresponding to the fuel shot is greater than a predetermined value.

12. The method of claim 9 wherein the adjustment comprises:

increasing the duration of a subsequent fuel shot for a predetermined condition when the rate of change in engine speed corresponding to the at least one fuel shot is less than a predetermined value; and decreasing the duration of a subsequent fuel shot for a predetermined condition when a rate of change in engine speed corresponding to the at least one fuel shot is greater than a predetermined value.

13. The method of claim 9 wherein the rail pressure drop comprises a rail pressure drop of a rail supplying fluid to the fuel injector.

14. The method of claim 13 wherein the fluid comprises one of:

gasoline;

diesel fuel; and hydraulic fluid.

15. The method of claim 9 wherein determining an adjustment to the fuel injection as a function of the rail pressure drop and the corresponding change in engine speed comprises determining an adjustment to the fuel injection as a function of a predetermined mathematical formula of a plurality of rail pressure drops and their corresponding changes in engine speed.

16. The method of claim 15 wherein the predetermined mathematical formula comprises at least one of:

an average of a plurality of rail pressure drops and their corresponding changes in engine speed; and a weighted average of a plurality of rail pressure drops and their corresponding changes in engine speed.

* * * * *